US007625020B2

(12) United States Patent
Fujimatsu et al.

(10) Patent No.: US 7,625,020 B2
(45) Date of Patent: Dec. 1, 2009

(54) VEHICLE DOOR LOCK CONTROL

(75) Inventors: Nobuyoshi Fujimatsu, Nirasaki (JP); Mitsuhiro Watanabe, Kai (JP); Hideaki Nozawa, Kai (JP)

(73) Assignee: Mitsui Mining and Smelting Co., Ltd. (JP)

( * ) Notice: Subject to any disclaimer, the term of this patent is extended or adjusted under 35 U.S.C. 154(b) by 284 days.

(21) Appl. No.: 11/755,382

(22) Filed: May 30, 2007

(65) Prior Publication Data

US 2008/0012355 A1 Jan. 17, 2008

(30) Foreign Application Priority Data

May 31, 2006 (JP) ..... 2006-151286

(51) Int. Cl.
*E05C 3/06* (2006.01)

(52) U.S. Cl. ..... 292/216; 292/201; 292/DIG. 23; 292/DIG. 38

(58) Field of Classification Search ..... 292/216, 292/201, DIG. 23
See application file for complete search history.

(56) References Cited

U.S. PATENT DOCUMENTS 6,050,620 A * 4/2000 Rogers et al. ..... 292/216
6,607,222 B2 * 8/2003 Inoue ..... 292/216
6,932,393 B2 * 8/2005 Erices ..... 292/216
7,080,861 B2 * 7/2006 Watanabe ..... 292/216
7,441,815 B2 * 10/2008 Umino ..... 292/216
7,458,621 B2 * 12/2008 Fujihara et al. ..... 292/216

FOREIGN PATENT DOCUMENTS

JP 2001-182403 7/2001
JP 2005-138696 6/2005

* cited by examiner

*Primary Examiner*—Peter M. Cuomo
*Assistant Examiner*—Mark Williams
(74) *Attorney, Agent, or Firm*—Ostrolenk Faber LLP

(57) ABSTRACT

A door of a vehicle is opened and closed by a handle mounted to the side of the door. In the door, a vehicle door lock control connected to the handle comprises a base plate on which an operating lever and a release lever are pivotally secured. The release lever is connected to a door-latching device which engages with or disengages from a vehicle body. The door is placed by a knob via a knob lever in a locked position where the door cannot be opened by the handle. The knob is coupled to the knob lever.

9 Claims, 11 Drawing Sheets

VEHICLE DOOR LOCK CONTROL

CROSS REFERENCE TO RELATED APPLICATION

The application claims the benefit of the filing date of Japanese Patent Application No. 2006-151286 filed 31 May 2006, the disclosure of which is hereby incorporated by reference.

BACKGROUND OF THE INVENTION

The present invention relates to a vehicle door lock control for interconnecting a door of a vehicle.

In JP2001-182403A and JP2005-138696A, a vehicle door lock control comprises an operating lever for releasing locked state according to a door-opening of an outside handle and an inside handle; a release lever connected to a door-latching device; a knob lever moving between an unlocking position where releasing operation of the operating lever can be transmitted to the release lever and a locked position where it cannot be transmitted; and a locking knob manually operating the knob lever from the inside of a vehicle.

However, in the vehicle door lock control, the locking knob is connected to the knob lever via various connecting members such as a rod and a lever, so that the number of parts increases to make its structure complicated.

The locking knob exposed inside the vehicle may preferably have a suitable color to fit with a plurality of interior colors of the vehicle. However, the vehicle door lock control is manufactured with the locking knob in a different part manufacturing line from a vehicle assembling manufacturing line. Then, parts thus produced are connected to doors in the vehicle manufacturing line where it would be difficult to exchange only locking knobs to fit with colors in the interior of the vehicle.

SUMMARY OF THE INVENTION

In view of the disadvantages, it is an object of the invention to provide a vehicle door lock control in which a locking knob is easily connected to a knob lever.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENT

Figure 3:
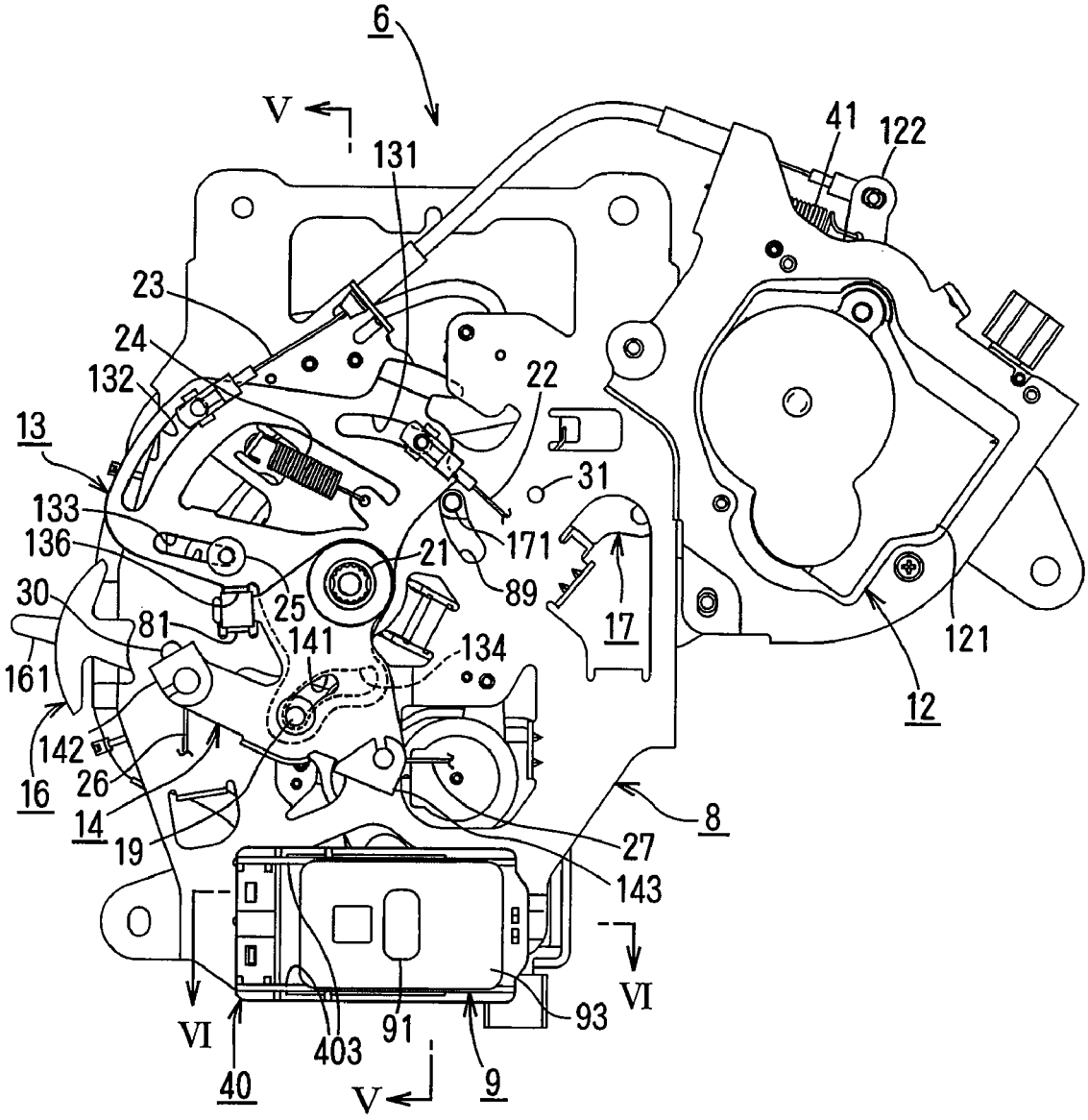
FIG. 3 is a side view of the vehicle door lock control seen from the inside of a vehicle.
Figure 4:
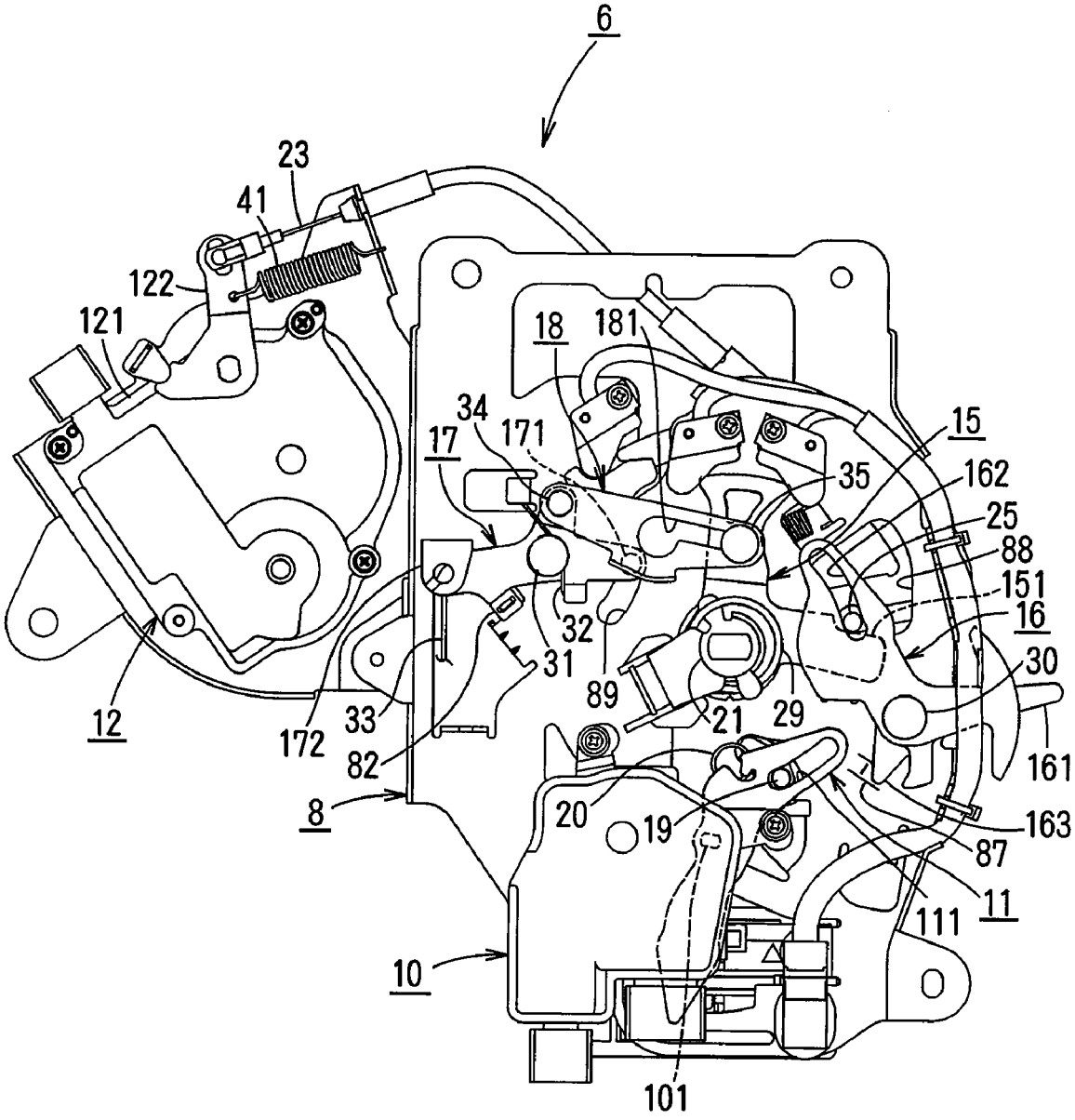
FIG. 4 is a side view of the vehicle door lock control seen from the outside of the vehicle.

In the following description, a left side in FIGS. 1, 3, 7 and 8 and a right side in FIG. 4 are the front of a vehicle, while a right side in FIGS. 1, 3, 7 and 8 and a left side in FIG. 4 are the rear. The front in FIGS. 1, 3, 7 and 8 and the rear in FIG. 4 are the inside of a vehicle, while the rear in FIGS. 1, 3, 7 and 8 and the front in FIG. 4 are the outside of the vehicle.

Figure 1:
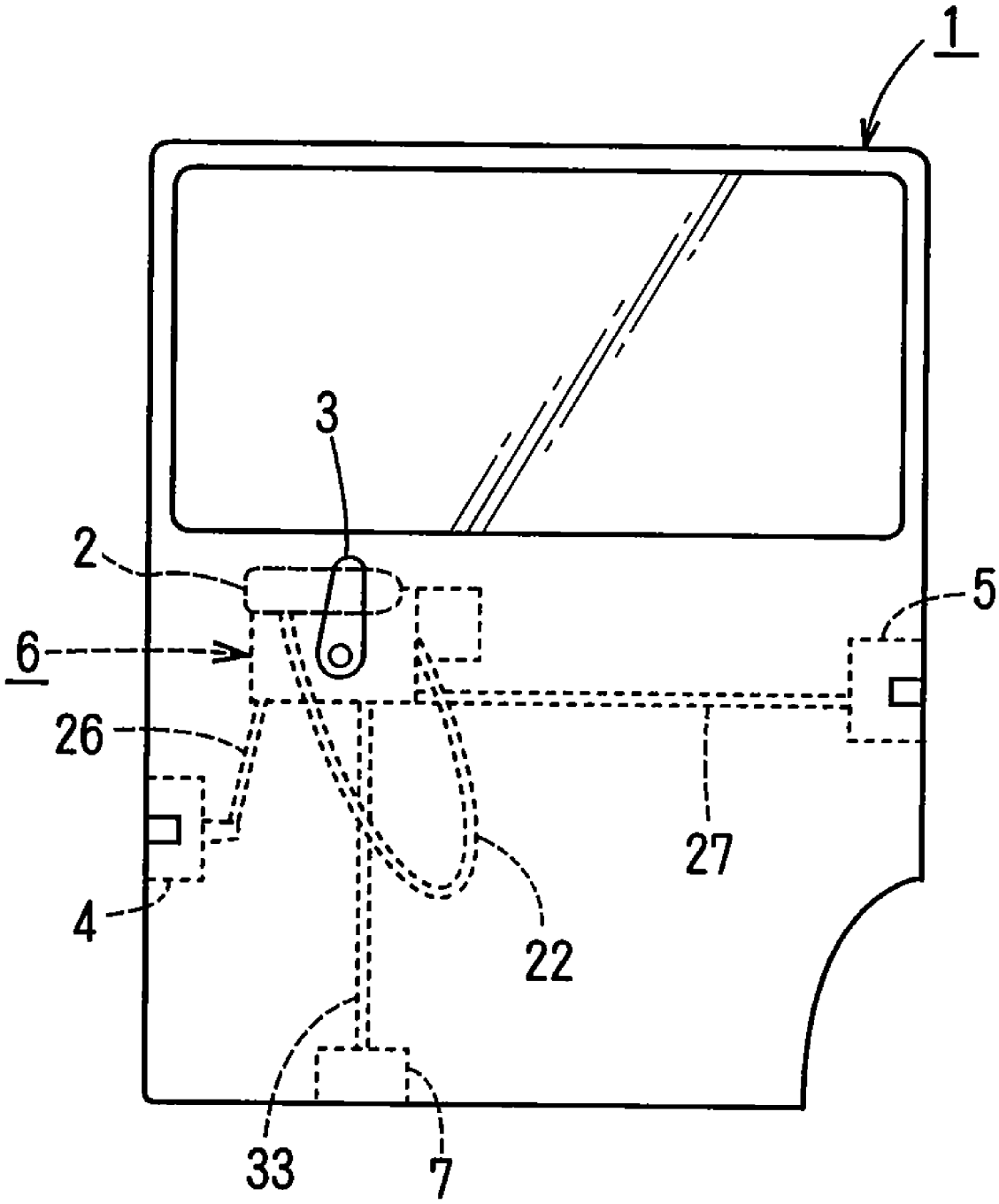
FIG. 1 is a side elevational view of a slide door to which the present invention is applied.

In FIG. 1, a slide door 1 is supported at the side of the vehicle body to move back and forth to enable the door 1 itself to open and close. An outside handle 2 is mounted to the outer side of the door 1 to open and close the door 1 outside the vehicle, and an inside handle 3 is mounted to the inner side of the door 1 to open and close the door 1 inside the vehicle.

At the front and rear ends of the door 1, there are a front door-latching device 4 and a rear door-latching device 5 which engage with a front striker (not shown) and a rear striker (not shown) fixed to a vehicle body respectively to hold the door 1 in a closed position. At the lower end of the door 1, a full-open latch device 7 for holding the door 1 in a fully-opened position is provided. In the front part of the door 1, a door-lock control 6 interconnects the outside handle 2 and the inside handle 3.

The present invention does not require both of the front door-latching device 4 and the rear door-latching device 5 but may have one of the devices 4 and 5.

Figure 2:
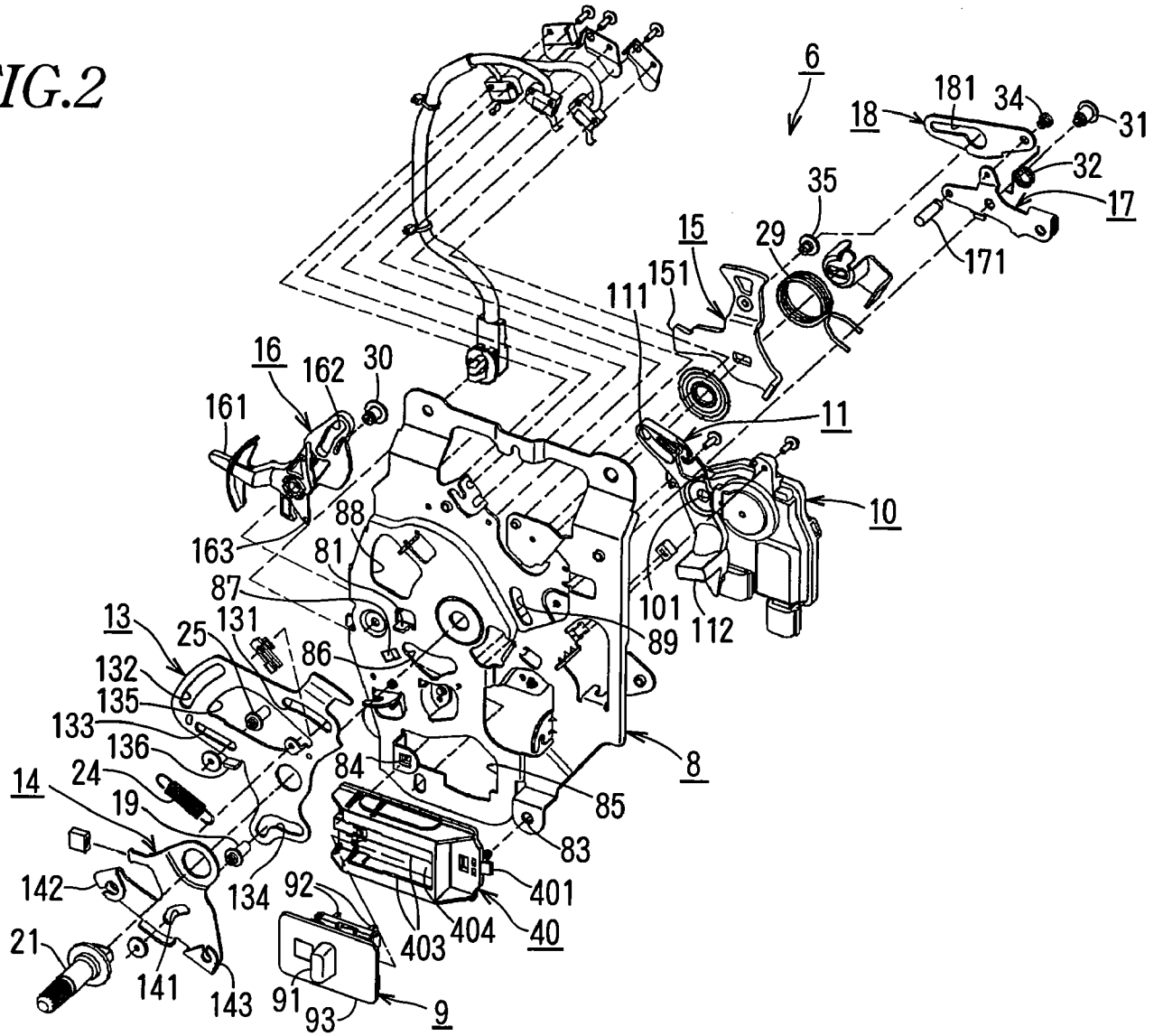
FIG. 2 is an exploded perspective view of a vehicle door lock control according to the present invention.

In FIG. 2, the door-lock control 6 comprises a base plate 8 fixed to the inner panel in the vehicle. The base plate 8 comprises a locking knob 9; a locking actuator 10, a knob lever 11; a releasing actuator 12 (not shown in FIG. 2); an outside lever 13 following the outside handle 2; a releasing lever 14; an inside lever 15 following the inside handle 3; a child-safety locking lever 16; a first full-open-latch releasing lever 17; and a second full-open latch releasing lever 18.

Figure 7:
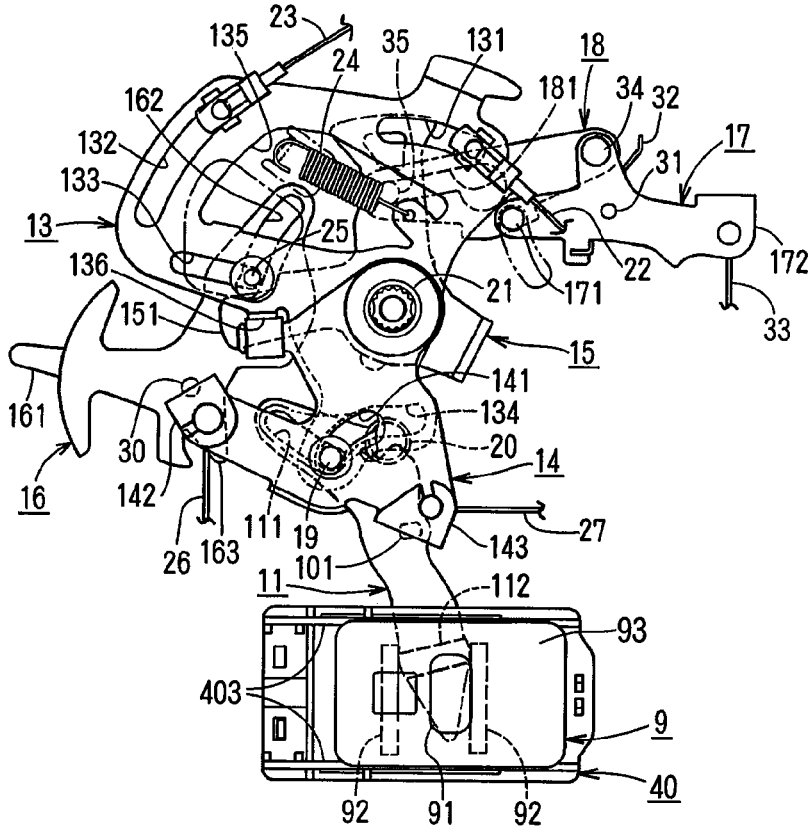
FIG. 7 is a view when the vehicle door lock control is in an unlocked position.
Figure 8:
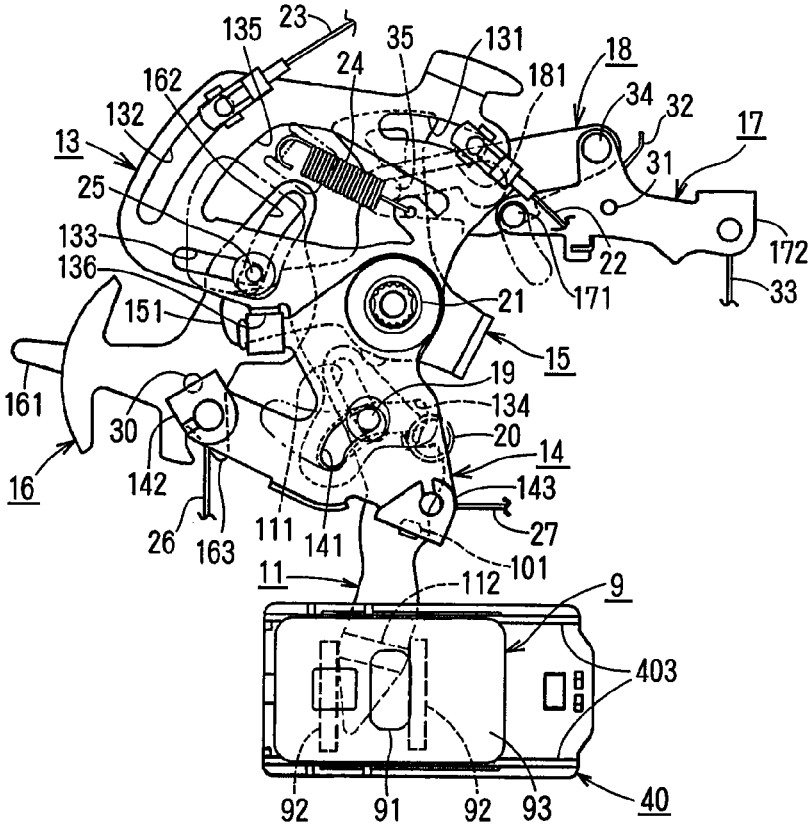
FIG. 8 is a view when the vehicle door lock control is in a locked position.
Figure 9:
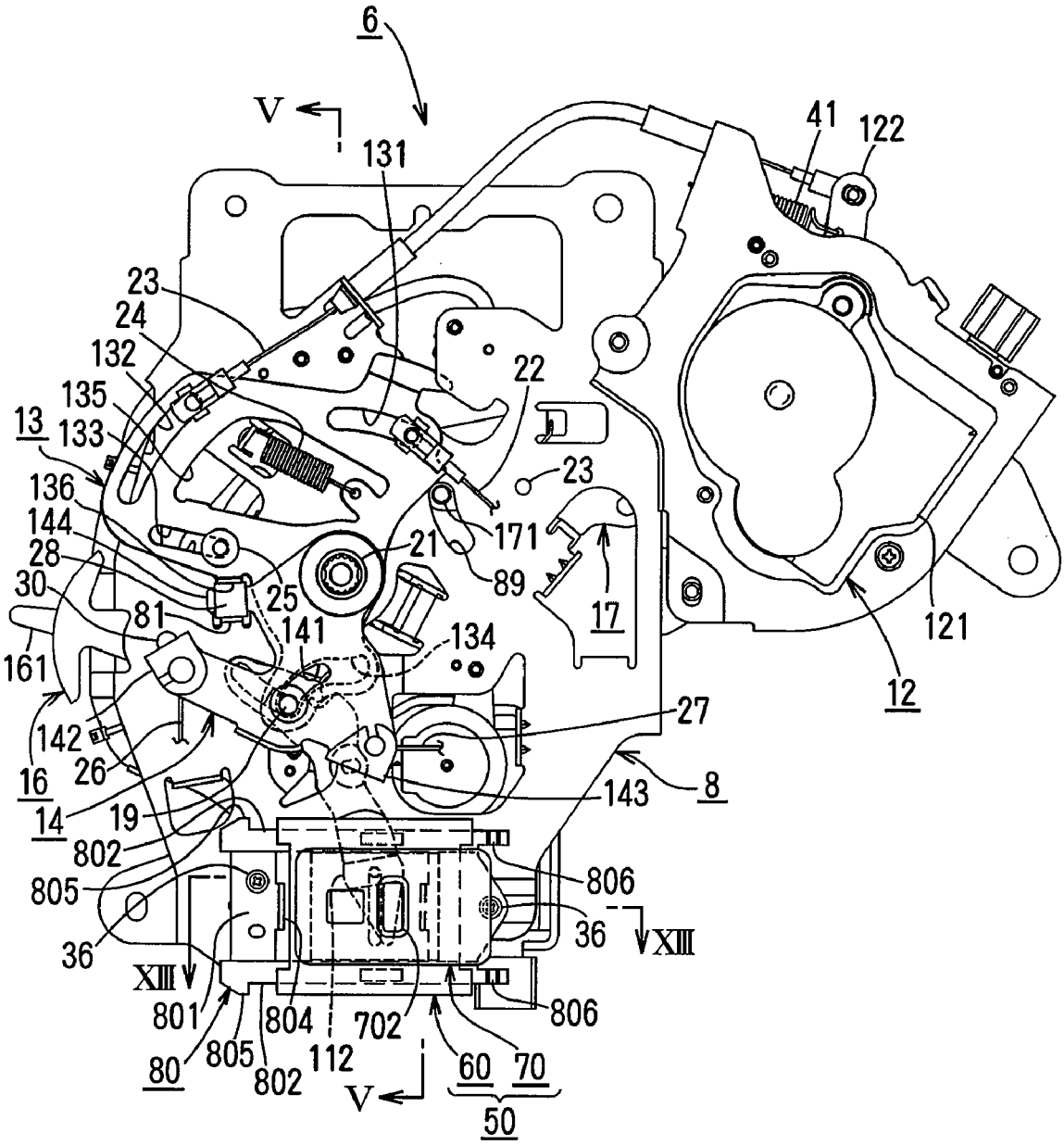
FIG. 9 is a side view of another embodiment of a vehicle door lock control seen from the inside of the vehicle.

The locking knob 9 is operated manually to switch between an unlocked state and a locked state of the door-lock control 6 from the inside of the vehicle, the locking knob 9 being slidingly mounted along a guide member 40 at the lower part of one side or a side facing the inside of the vehicle of the base plate 8 to move between an unlocked position in FIGS. 3 and 7 and a locked position in FIG. 8. Detailed description about the locking knob 9 and the guide member 40 will be provided later.

The unlocked state of the door-lock control 6 means that the door 1 can be opened by the outside handle 2 and inside handle 3 while the locking knob 9, the knob lever 11 and a lock control pin 19 are in the unlocked position. The locked state means that the door 1 cannot be opened by the outside handle 2 and inside handle 3 while the locking knob 9, the knob lever 11 and the lock control pin 19 are in the locked position. The unlocked position and locked position of the knob lever 11 and lock control pin 19 will be described later.

The locking actuator 10 switches the door-lock control 6 to the locked state or the unlocked state by a motor and is mounted on the lower part of the other side of the base plate 8 facing the outside of the vehicle. The actuator 10 is driven by locking/unlocking operation of a wireless switch (not shown) or an operating switch on a driver's seat. The locking knob 9 on the one side of the base plate 8 faces the locking actuator 10 on the other side.

The knob lever 11 is bent and the middle is pivotally secured to an output shaft 101 of the locking actuator 10. The output shaft 101 is a shaft which slows down rotation of the motor for the locking actuator 10 and outputs it.

Accordingly, the locking actuator 10 is fixed on the other side of the base plate 8, so that the knob lever 11 is rotatably supported on the other side of the base plate 8.

Instead of the structure in which the knob lever 11 is pivotally secured to the output shaft 101 of the locking actuator 10, the knob lever 11 may be pivotally secured directly or indirectly to the one side or other side via another pivot.

At the lower part of the knob lever 11, a projection 112 passes through a first opening 85 of the base plate 8, projects from the one side of the base plate 8 and is coupled to the locking knob 9. A slit 111 through which a lock control pin 19 extending transversely of the vehicle slidingly engages is formed at the upper part of the knob lever 11. The slit 111 is formed like an arc around an operating shaft 21 later described when the knob lever 11 is in the unlocked position.

The knob lever 11 manually operated by the locking knob 9 turns between the unlocked position in FIGS. 4 and 7 and the locked position in FIG. 8 by the locking actuator 10, so that the knob lever 11 is held in each of the positions by force of the spring 20.

The releasing actuator 12 releases the front door-latching device 4, rear door-latching device 5 and fully-open-latching device 7 by a motor, and. is mounted to the rear part of the base plate 8. Based on releasing of a wireless switch (not shown) and a switch by the driver's seat, an output lever 122 pivotally secured to the housing 121 including a motor, a reduction gear etc. is moved for releasing from a standby position in FIG. 4 in a releasing direction or an anticlockwise direction in FIG. 4 against the force of the spring 41.

The outside lever 13 is pivotally secured in the middle of the one side of the base plate 8 with an operating shaft 21 extending transversely of the vehicle with a collar and connected to the outside handle 2 and the output lever 122 of the releasing actuator 12 via a first cable 22 and a second cable 23. Thus, by door-opening of the outside handle 2 or driving of the releasing actuator 12, the output lever 122 is moved for releasing, so that the outside lever 13 is moved for releasing against the force of the spring 24 from the standby position in FIGS. 3 and 7 in a releasing direction or a clockwise direction in FIGS. 3 and 7.

At the upper part of the outside lever 13, there is formed a first connecting portion 131 which slidingly engages with the end of the first cable 22. In front of the first connecting portion 131, there is formed a second connecting portion 132 which slidingly engages with the end of the second cable 23 for transmitting power of the releasing actuator 12. Below the second connecting portion 132, there is formed a slit 133 in which a child-safety lock control pin 25 described later slidingly engages. The first and second connecting portions 131, 132 comprise slits like arcs having an operating shaft as a center.

At the lower part of the outside lever 13, there is formed an inverted L-shaped control hole 134 in which the lock control pin 19 slidingly engages. The control hole 134 coincides with a slit 111 of the knob lever 11 via the base plate 8.

The release lever 14 is pivotally secured to one side of the base plate 8 with the operating shaft 21. At the lower part of the release lever 14, there is formed a control hole 141 which slidingly engages with the lock control pin 19 and coincides with the control hole 134 of the outside lever 13 in position. The outside lever 13 and release lever 14 are pivotally secured to turn separately from the operating shaft 21.

A third connecting portion 142 and a fourth connecting portion 143 at the lower part of the release lever 14 are connected to the front door-latching device 4 and the rear door-latching device 5 via the third cable 26 and the fourth cable 27 which enable releasing of the release lever 14 to be transmitted.

The release lever 14 is moved for releasing which is transmitted to the front door-latching device 4 and the rear door-latching device 5 via the third cable 26 and fourth cable 27.

The releasing is transmitted to the front door-latching device 4 and the rear door-latching device 5, which disengage from the strikers respectively to enable the door 1 to open.

The lock control pin 19 passes through the second opening 86 of the base plate 8 and projects from the base plate 8. Thus, the end projecting from the other side of the base plate 8 slidingly engages in the slit 111 of the knob lever 11, while the end projecting from the one side of the base plate 8 slidingly engages in the control hole 134 of the outside lever 13 and the control hole 141 of the release lever 14.

The lock control pin 19 follows motion of the knob lever 11 to the unlocked position and the locked position to move in the control hole 134 of the outside lever 13 and in the control hole 141 of the release lever 14. When the knob lever 11 is in the unlocked position, the pin 19 is held in the unlocked position in FIGS. 3 and 7 on the end of the control hole 134 of the outside lever 13 and when the knob lever 11 is in the locked position, the pin 19 is held in the locked position in FIG. 8 in the middle of the control hole 134.

When the lock control pin 19 is in the unlocked position, releasing of the outside lever 13 can be transmitted to the release lever 14. Specifically, the outside lever 13 is moved for releasing from the standby position to enable the lock control pin 19 to contact the end of the control hole 134 and to enable the pin 19 to move from the front end to the rear end of the slit 111. Thus, the lock control pin 19 engages in the control hole 141 of the release lever 14 to enable the release lever 14 to move for releasing from the standby position in FIGS. 3, 7 and 8. However, when the lock control pin 19 is in the locked position, the lock control pin 19 moves only in the control hole 134 of the outside lever 13, but releasing operation of the outside lever 13 is not transmitted to the release lever 14.

The inside lever 15 is pivotally secured at the other side of the base plate 8 to turn together with the operating shaft 21 and can turn against the force of the spring 29 from the neutral position in FIGS. 4, 7 and 8 in a door-opening direction or a clockwise direction in FIGS. 7 and 8 and a door-closing direction or an anticlockwise direction in FIGS. 7 and 8. The inside handle 3 is mounted to the end of the operating shaft 21.

The child-safety lock lever 16 is pivotally secured to the front part of the other side of the base plate 8 with a pivot 30 extending transversely of the vehicle to make it possible to move from the unlocked position in FIGS. 4, 7 and 8 to the locked position or a position where it turns from the unlocked position in an anticlockwise direction to some extent in FIGS. 7 and 8 and vice versa.

At the lower part of the child-safety lock lever 16, there is provided an elastic arm 163 elastically deformable in a transverse direction of the vehicle. The elastic arm 163 engages with a protrusion 87 provided at the other side of the base plate 8 to hold the child-safety lock lever 16 elastically in the unlocked position and locked position.

The child-safety lock control pin 25 which slidingly engages a slit 133 of the outside lever 13 passes through a third opening 88 and slidingly engages in a slit 162 at the upper part of the child-safety lock lever 16.

When the child-safety lock lever 16 moves to the unlocked position, the child-safety lock control pin 25 moves in the slit 133 of the outside lever 13 to a position where it can engage with an arm 151 of the inside lever 15 and is held. Thus, when the child-safety lock lever 16 is in the unlocked position, the inside lever 15 turns in a door-open direction to enable the arm 151 to release the outside lever 13 via the child-safety lock control pin 25. So, the door 1 can be opened.

When the child-safety lock lever 16 is in the locked position, the child-safety lock control pin 25 is held in a position where it cannot engage with the arm 151. Even if the inside lever 15 turns in a door-opening direction, it is not transmitted to the outside lever 13. So the door 1 cannot be opened.

The first fully-open-latching release lever 17 is pivotally secured to the other side of the base plate 8 with the pivot 31 extending transversely of the vehicle and held in the standby position in FIGS. 4, 7 and 8 where it contacts a stopper 82 of the base plate 8 by the force of the spring 32.

At the rear end of the first fully-open-latching release lever 17, a fifth connecting portion 172 is coupled to the upper end of a fifth cable 33 vertically extending and connected to the fully-open latch device 7. At the front end, an engagement pin 171 is provided. The engagement pin 171 extends through an arcuate hole 89 of the base plate 8 and projects from the one side of the base plate 8. When the outside lever 13 moves for releasing, the pin 171 engages with the outside lever 13 and moves downwards thereby causing releasing operation of the first fully-open latch lever 17.

The second fully-open-latching release lever 18 is pivotally secured to the upper part of the first fully-open-latching release lever 17 with the connecting shaft 34, and the connecting shaft 35 at the upper part of the inside lever 15 slidingly engages in a slit 181.

The inside lever 15 turns from the neutral position in a door-opening direction. So the first fully-open-latching release lever 17 achieves releasing operation from the standby position in FIGS. 4, 7 and 8 via the second fully-open-latching release lever 18. Releasing operation of the first fully-open-latching release lever 17 results in releasing operation of the fully-open latch device 7 to enable the door held in the fully-open position to close. When the outside lever 13 achieves releasing operation, the engagement pin 171 engages with the outside lever 13 thereby achieving releasing operation of the first fully-open-latching release lever 17.

The locking knob 9 is made of synthetic resin and comprises an operating part 91 which is exposed inside the vehicle and can be operated inside; a slider portion 93 which slidingly engages in the guide member 40 back and forth; and a pair of engagement arms 92 between which a projection 112 of the knob lever 11 fits. The knob 9 is mounted to the base plate 8 to move between the unlocked position in FIGS. 3 and 7 where the door lock control 6 is in the unlocked state and the locked position in FIG. 8 where the door lock control 6 is in the locked state.

Figure 5:
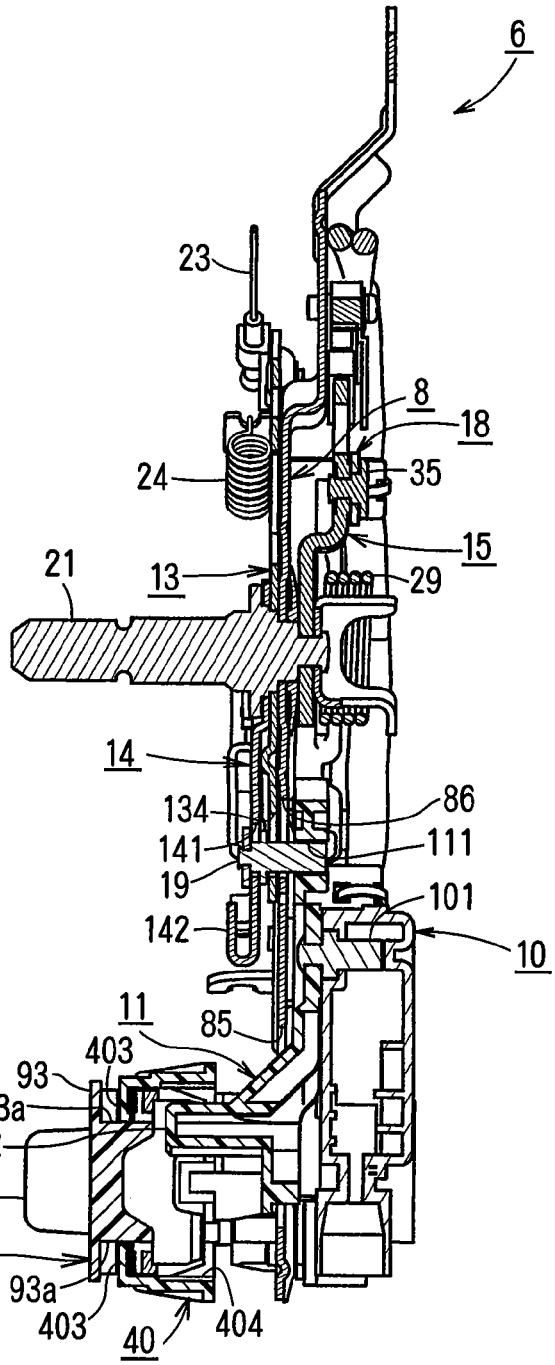
FIG. 5 is a vertical sectional view taken along the line V-V in FIG. 3.

A pair of guides 403,403 of the guide member 40 engages with upper and lower grooves 93*a*,93*a* in FIG. 5 of the slider portion 93 to allow the locking knob 9 to engage in the guide member 40 slidingly.

Figure 6:
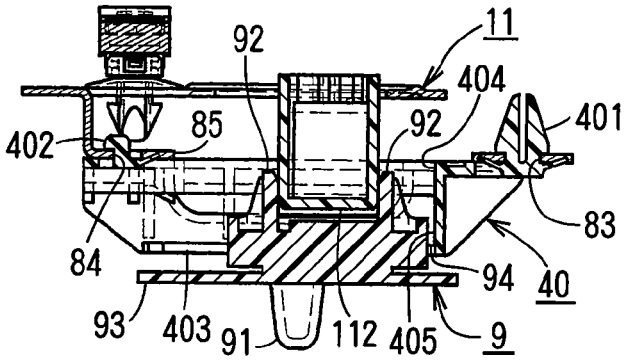
FIG. 6 is a horizontal sectional view taken along the line VI-VI in FIG. 3.

In FIG. 6, the guide member 40 is made of synthetic resin and fixed to the base plate 8 by engaging projections 401,402 in engagement holes 83,84.

The front projection 401 is pressed into the front engagement hole 83 to elastically engage in the hole 83. The rear projection 402 is formed like an L and moved rearwards while it is inserted in the engagement hole 84 to engage on the other side of the base plate 8.

The locking knob 9 previously coupled to the guide member 40 is connected to the knob lever 11 by engagement of the arms 92,92 with the projection 112 of the knob lever 11 by fixing the guide member 40 to the base plate 8 on which main components such as the locking actuator 10, the knob lever 11, the outside lever 13, the release lever 14 and the inside lever 15 are joined.

Specifically, while the locking knob 9 is mounted to the guide member 40, the rear projection 402 of the guide member 40 engages in the rear engagement hole 84, the projection 112 of the knob lever 11 projecting in the opening 404 of the guide member 40 is fit between the arms 92 and 92 of the locking knob 9. Then, the front projection 401 is engaged in the front engagement hole 84. Thus, the guide member 40 is fixed to the one side of the base plate 8 and the locking knob 9 is slidingly supported on the base plate 8 via the guide member 40 and joined to the knob lever 11. Thus, the locking knob 9 can be easily joined to the knob lever 11 without being obstructed by another part. In a vehicle assembly line, a color of the locking knob 9 is selected to fit with an interior color in the vehicle and mounted to the door lock control 6 for easy connecting to the knob lever 11.

Between the arms 92 and 92 of the locking knob 9, the projection 112 of the knob lever 11 is put to allow the locking knob 9 to be coupled to the knob lever 11 directly, so that the knob lever 11 can be joined to the locking knob 9 easily and firmly without extra parts. Furthermore, the knob lever 11 is pivotally secured to the output shaft 101, so that the knob lever 11 can be pivotally mounted at the other side of the base plate 8 without another pivot.

When the locking knob 9 connected to the knob lever 11 is in the unlocked position, a rear end face 94 of the locking knob 9 comes closer to a stopper 405 of the guide member 40 thereby limiting a moving range of the locking knob 9.

Another embodiment of the present invention will be described with respect to FIGS. 9-15.

Figure 10:
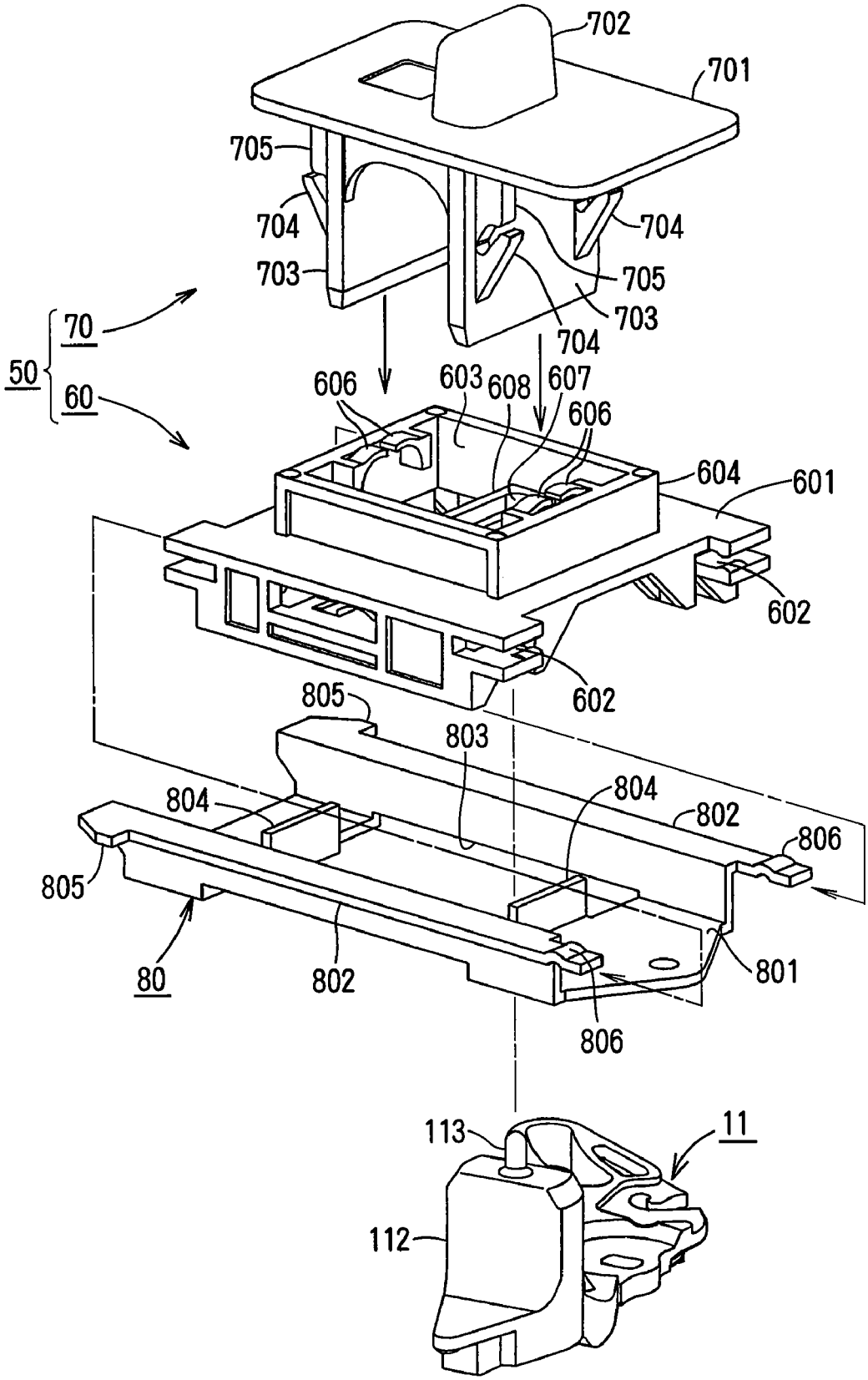
FIG. 10 is an exploded perspective view thereof.
Figure 11:
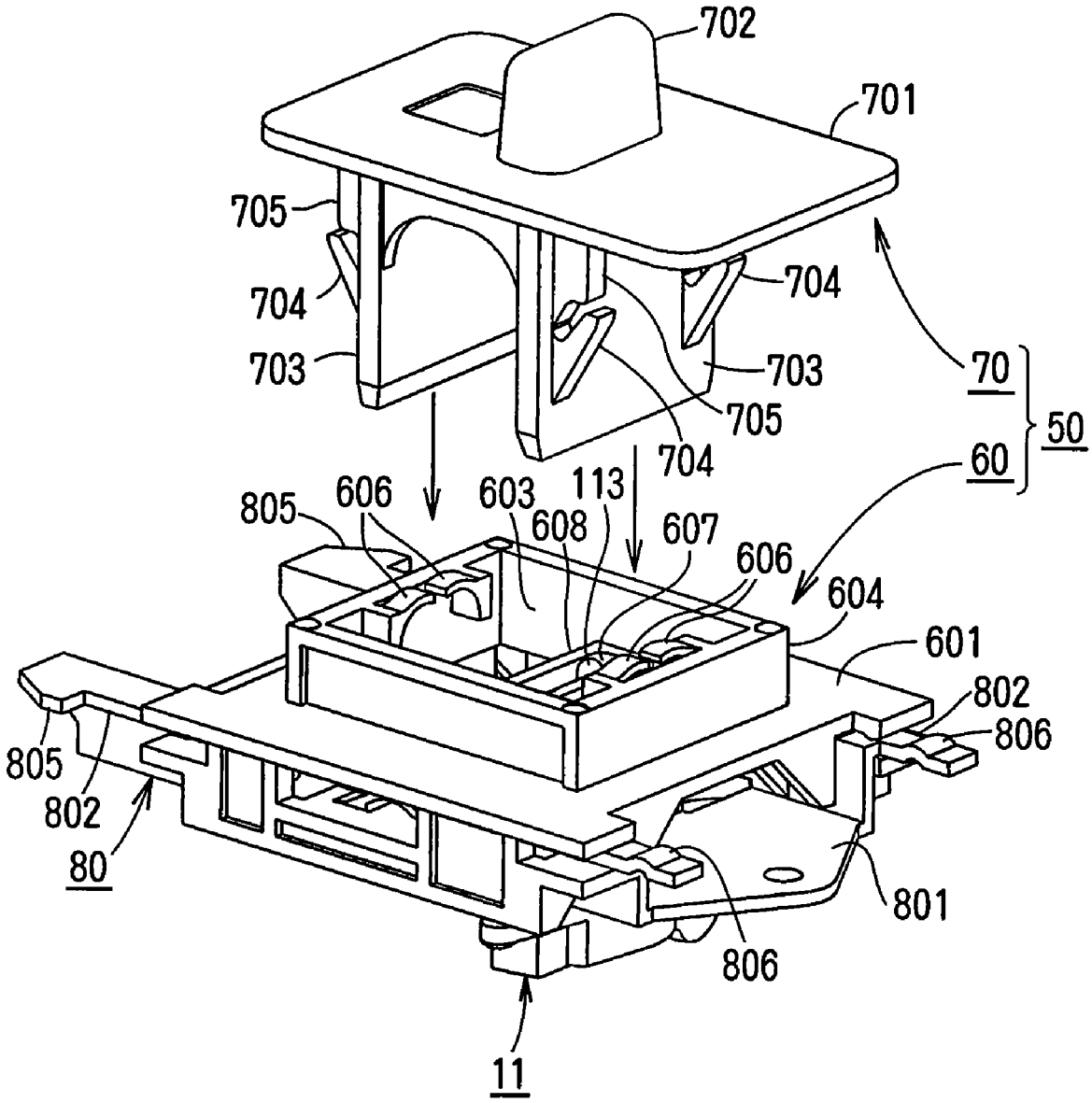
FIG. 11 is a partial exploded perspective view thereof.
Figure 12:
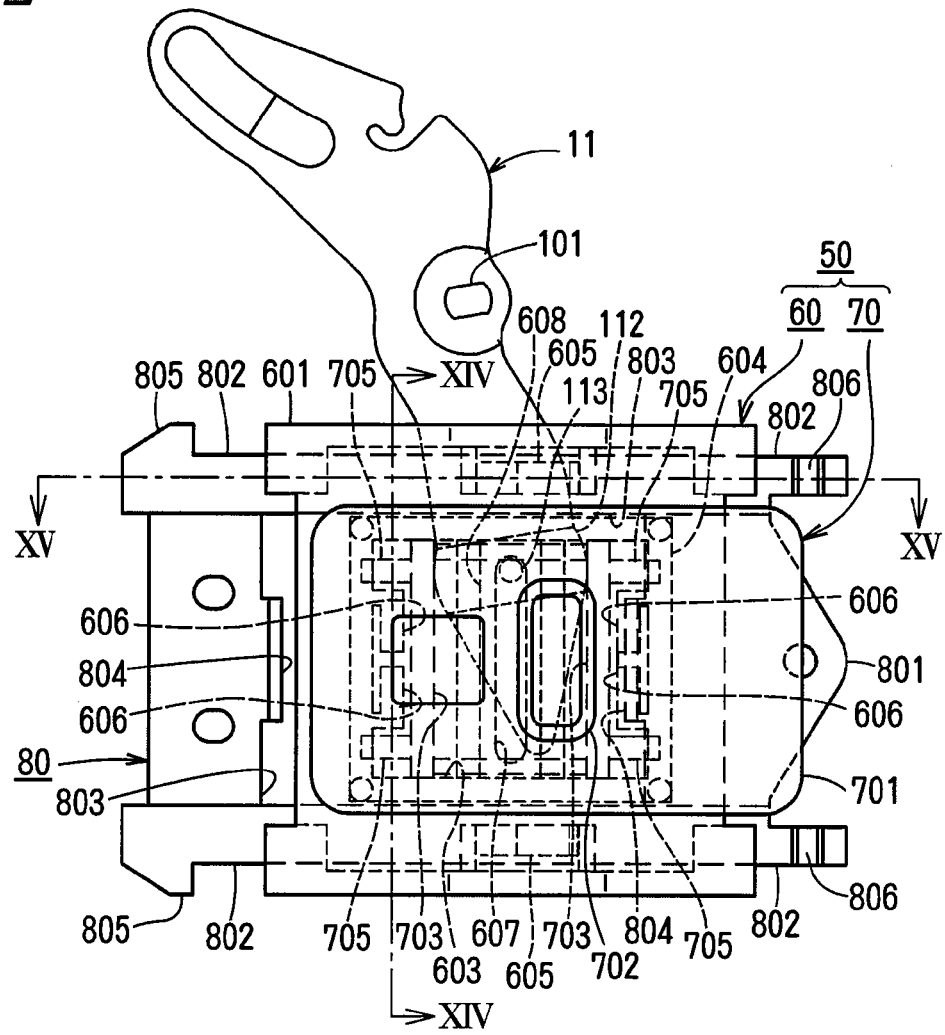
FIG. 12 is a side view thereof.

In FIGS. 10 and 11, upper left side is deemed "front"; lower right side is deemed "rear"; upper part is deemed "inside the vehicle"; and lower part is deemed "outside the vehicle".

A locking knob 50 in the embodiment is divided into a synthetic-resin slider 60 which can slide back and forth along a guide member 80 fixed to one side of a base plate 8 with a bolt 36; and a synthetic-resin operating portion 70 exposed inside a vehicle and operated in the interior.

The embodiment is the same as the former embodiment except the locking knob 50, guide member 80 or knob lever 11 and description thereof is omitted.

The guide member 80 made of a thin metal plate comprises a base 801 fixed to the one side of the base plate 8 with a bolt 36; and a pair of guide portions 802,802 vertically extending from the base 801. In the middle of the base 801, an opening 803 is formed and stoppers 804,804 are formed at the front and rear edges of the opening 803. At the front end of the guide portions 802, projections 805 limit motion of the slider 60. A lobe 806 is formed on the rear end of the guide portion 802. The lobe 806 prevents the slider 60 from falling out of the guide portion 802 after the slider 60 is mounted to the guide member 80.

In the embodiment, the guide member 80 is made separately from the base plate 8, and the slider 60 is connected to the base plate 8 slidingly via the guide member 80. Instead, parts such as the guide portion 802 and stopper 804 of the guide member 80 may be formed together with the base plate 8 and the slider 60 may be directly mounted to the base plate 8 slidingly.

The slider 60 comprises a rectangular base 601. Grooves 602,602 of the base 601 engage with the guide potions 802, 802 of the guide member 80 to enable the slider 60 to slide along the guide member 80. The slider 60 can move between an unlocked position in FIGS. 9 and 12 and a locked position.

In the middle of the base 601, an opening 603 is surrounded by a wall 604.

In the middle of the opening 603 of the slider 60, a bridge 608 having a slit 607 is formed. A second elastic tongue 606 which is elastically deformable transversely of the vehicle is formed on the inner surface of the wall 604. When the operating portion 70 is fixed to the slider 60 as described later, the second elastic tongue 606 elastically contacts the rear surface of a cover portion 701 of the operating portion 70 to prevent loosening.

In the former embodiment, between the slider 93 of the locking knob 9 and the guide portion 403 of the guide member 40, it is also possible to provide an elastic tongue achieving similar action to the second elastic tongue 606.

The slider 60 is connected to the guide member 80 slidingly and the guide member 80 is fixed to the base plate 8 with the bolt 36. The slit 607 engages with a smaller projection 113 of a projection 112 of the knob lever 11 achieving temporary connection to the knob lever 11.

The operating portion 70 comprises a cover 701 covering the slider 60 to prevent exposure to the inside; and a pair of arms 703,703 connected to the knob lever 11.

Figure 13:
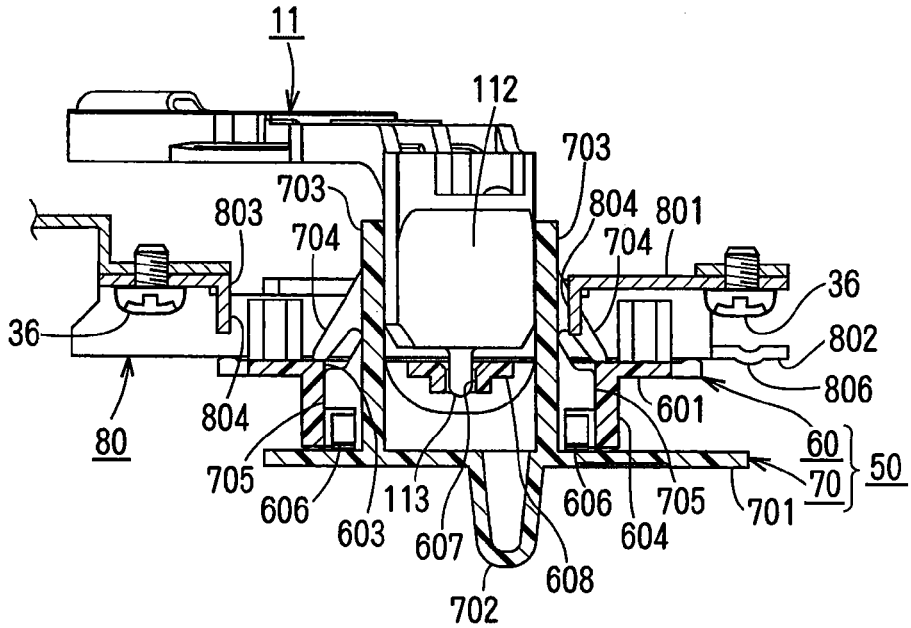
FIG. 13 is a horizontal sectional view taken along the line XIII-XIII in FIG. 9.
Figure 14:
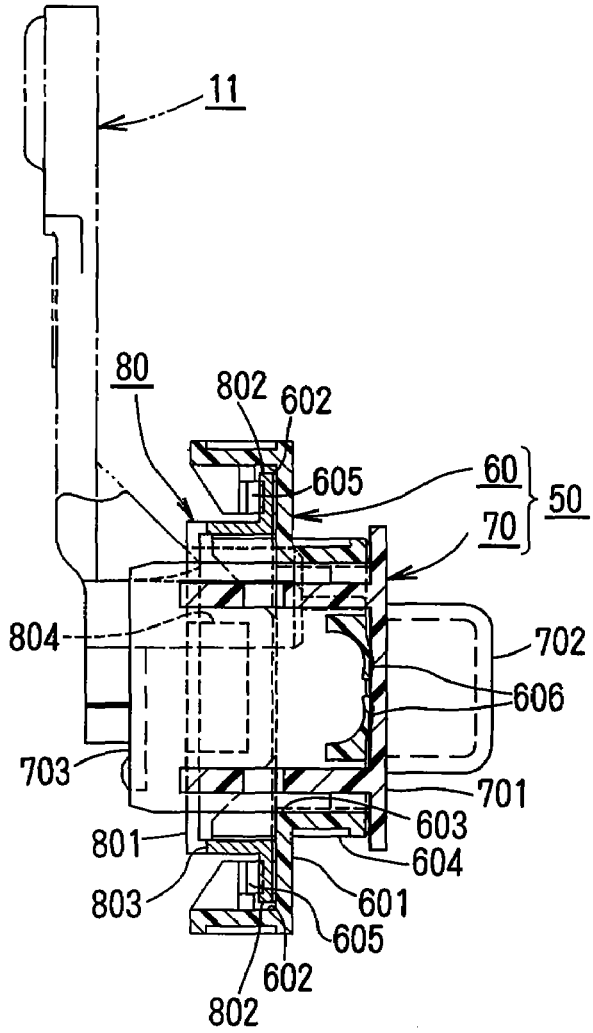
FIG. 14 is a vertical sectional view taken along the line XIV-XIV in FIG. 12.
Figure 15:
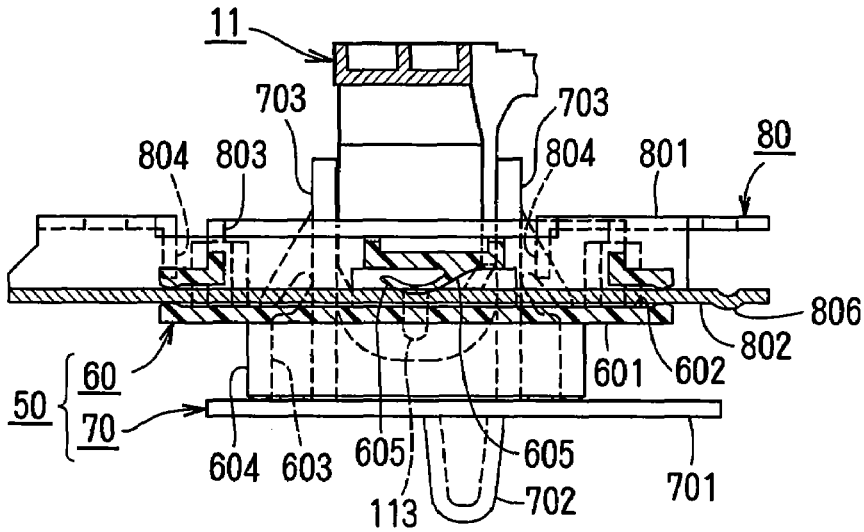
FIG. 15 is a horizontal sectional view taken along the line XV-XV in FIG. 12.

In FIG. 13, the arm 703 comprises an elastic claw 704 and a contact portion 705 which contacts the inner surface of the wall 604 of the slider 60. The elastic claw 704 contacts the slider 60, and the contact portion 705 contacts the inner surface of the wall 604, so that the operating portion 70 is mounted to move together with the slider 60.

The operating portion 70 can be mounted to the slider 60 which is in sliding contact with the base plate 8, via the guide member 80. Specifically, the arms 703,703 of the operating portion 70 are inserted into the opening 603 of the slider 60 from the inside of the vehicle. Thus, in FIG. 13, the contact portions 705,705 contact the inner surfaces of the walls 604, 604; the elastic claws 704,704 engage on the rear surface of the slider 60 to prevent disengagement; and the projection 112 of the knob lever 11 is fit between the arms 703 and 703. Thus, the operating portion 70 is mounted to the slider 60 and engaged with the projection 112 of the knob lever 11 for connection.

In the embodiment, the locking knob 50 is divided into the slider 60 and the operating portion 70. The operating portion 70 is easily coupled to the slider 60 which is in sliding contact with the base plate 8, without being interrupted by other parts.

Thus, in a vehicle assembling line, the operating portion 70 of a color fitting with the interior color of the vehicle is only selected enabling the knob lever 11 to be easily connected.

Between the arms 703 and 703 of the operating portion 70, the projection 112 of the knob lever 11 engages to connect the operating portion 70 to the knob lever 11 directly. So the operating portion 70 is coupled to the knob lever 11 easily and surely.

When the locking knob 50 is connected to the knob lever 11, the locking knob 50 moves to the unlocked position or locked position, and the outer side surface of the arm 703 of the operating portion 70 comes closer to the stopper 804 of the guide member 80 enabling contact. A motion range of the locking knob 50 is restricted, thereby preventing the knob lever 11 from being subjected to excessive load when the locking knob 50 is operated.

The foregoing merely relates to embodiments of the invention. Various changes and modifications may be made by a person skilled in the art without departing from the scope of claims wherein:

What is claimed is:

1. A vehicle door lock control comprising:

an operating handle mounted to a door of a vehicle;

a base plate fixed in the door and having at least one opening, the base plate comprising a first side that faces an interior of the vehicle and a second side that faces an exterior of the vehicle;

an operating lever pivotally secured to the base plate and connected to the operating handle so that door-opening operation of the operating handle is transmitted to the operating lever;

a door-latching device mounted to the door to allow the door to engage with or disengage from a body of the vehicle;

a release lever pivotally secured to the base plate and connected to the door-latching device;

a knob lever disposed on the second side of the base plate, the knob lever being capable of moving between an unlocked position where the operating lever allows the door-latching device to disengage from the body of the vehicle via the release lever and a locked position where the operating lever does not allow the door-latching device to disengage from the body of the vehicle via the release lever;

a guide member fixed to the first side of the base plate and having an opening; and a locking knob operated manually from the interior of the vehicle, the locking knob comprising an operating portion that can be operated in the interior of the vehicle, a slider that is slidably coupled to the guide member and a connecting portion coupled to the knob lever through one opening of the at least one opening in the base plate and the opening in the guide member to operate the knob lever to the unlocked position or the locked position.

2. A vehicle door lock control of claim 1 wherein the operating portion comprises a projection.

3. A vehicle door lock control of claim 1 wherein the connecting portion comprises a pair of arms between which the knob lever engages.

4. A vehicle door lock control of claim 1 wherein the operating portion is detachably mounted to the slider.

5. A vehicle door lock control of claim 1 further comprising an operating shaft fixed to the base plate, the operating lever and the release lever being pivotally secured about the operating shaft to turn separately.

6. A vehicle door lock control of claim 1 wherein the door comprises a slide door.

7. A vehicle door lock control of claim 1 wherein the operating handle comprises an outside handle fixed to the door outside the vehicle, the operating lever comprising an outside lever connected to the outside handle.

8. A vehicle door lock control of claim 1 wherein the outside lever and the release lever are disposed at the first side of the base plate, the knob lever being disposed at the second side of the base plate, a lock control pin slidingly engaging in a slit of the knob lever and passing through an opening of the base plate to slidingly engage in a first control hole of the operating lever and in a second control hole of the release lever.

9. A vehicle door lock control comprising:

an operating handle mounted to a door of a vehicle;

a base plate fixed in the door;

an operating lever pivotally secured to the base plate and connected to the operating handle so that door-opening operation of the operating handle is transmitted to the operating lever;

a door-latching device mounted to the door to allow the door to engage with or disengage from a body of the vehicle;

a release lever pivotally secured to the base plate and connected to the door-latching device;

a knob lever capable of moving between an unlocked position where the operating lever allows the door-latching device to disengage from the body of the vehicle via the release lever and a locked position where the operating lever does not allow the door-latching device to disengage from the body of the vehicle via the release lever; and a locking knob coupled to the knob lever of the base plate to operate the knob lever to the unlocked position and the locked position;

wherein the operating lever and the release lever are disposed at one side of the base plate, the knob lever being disposed at the other side of the base plate, a lock control pin slidingly engaging in a slit of the knob lever and passing through an opening of the base plate to slidingly engage in a control hole of the operating lever and in a control hole of the release lever, the lock control pin following motion of the knob lever to the unlocked position and the locked position to move in the control hole of the operating lever and in the control hole of the release lever, an unlocked position of the lock control pin allowing release of the operating lever to be transmitted to the release lever and a locked position of the lock control pin not allowing release of the operating lever to be transmitted to the release lever.

* * * * *